US008929796B2

(12) United States Patent
Tojo

(10) Patent No.: US 8,929,796 B2
(45) Date of Patent: Jan. 6, 2015

(54) RECOVERY TONER CONTAINER AND IMAGE FORMING APPARATUS

(71) Applicant: Canon Kabushiki Kaisha, Tokyo (JP)

(72) Inventor: Arata Tojo, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 13/709,757

(22) Filed: Dec. 10, 2012

(65) Prior Publication Data

US 2013/0216289 A1 Aug. 22, 2013

(30) Foreign Application Priority Data

Feb. 17, 2012 (JP) ..... 2012-032371

(51) Int. Cl.
*G03G 21/12* (2006.01)
*G03G 21/10* (2006.01)

(52) U.S. Cl.
CPC ..... *G03G 21/12* (2013.01); *G03G 21/105* (2013.01)
USPC ..... 399/360; 399/35; 399/101

(58) Field of Classification Search
USPC ..... 399/360, 35, 101, 123, 110, 358
See application file for complete search history.

(56) References Cited

U.S. PATENT DOCUMENTS

| | | | | |
|---|---|---|---|---|
| 2007/0292179 | A1* | 12/2007 | Kudo | 399/360 X |
| 2010/0215398 | A1 | 8/2010 | Iikura | |
| 2012/0121278 | A1* | 5/2012 | Kitagawa | 399/35 |

FOREIGN PATENT DOCUMENTS

| | | | | |
|---|---|---|---|---|
| CN | 101813901 | A | | 8/2010 |
| JP | 9325662 | A | | 12/1997 |
| JP | 2008077115 | A | | 4/2008 |
| JP | 2009300635 | A | | 12/2009 |
| JP | 4435824 | B2 | | 3/2010 |
| JP | 2011085745 | A | | 4/2011 |
| JP | 2011-133510 | A | * | 7/2011 |
| JP | 4985740 | B2 | | 7/2012 |

OTHER PUBLICATIONS

Machine translation of JP 2009-300635, translated on Feb. 21, 2014.*

* cited by examiner

*Primary Examiner* — Sophia S Chen
(74) *Attorney, Agent, or Firm* — Fitzpatrick, Cella, Harper & Scinto

(57) ABSTRACT

A toner container detachably attachable to an image forming apparatus body. The toner container includes a recovery container body in which at least one inflow port is formed for inflow of a toner recovered after image formation, and at least one rotating member that is rotatably provided to convey the recovered toner, which flows from the inflow port into the recovery container body, to a downstream side in a recovery toner conveyance direction. The rotating member includes a screw member and a spiral screw member. A discharge port, which is formed at the downstream side in the recovery toner conveyance direction, discharges the recovered toner in the recovery container body. A cover member, which is arranged to be detachably attachable to the recovery container body and has a bearing portion fitted to a downstream end in the recovery toner conveyance direction of the rotating member, covers the discharge port.

2 Claims, 8 Drawing Sheets

RECOVERY TONER CONTAINER AND IMAGE FORMING APPARATUS

CLAIM OF PRIORITY

This application claims the benefit of Japanese Patent Application No. 2012-032371, filed Feb. 17, 2012, which is hereby incorporated by reference herein in its entirety.

BACKGROUND OF THE INVENTION

1. Field of the Invention

The present invention relates to an image forming apparatus such as a printer, a copier, or a facsimile, and, in particular, to a recovery toner container for recovering removed residual transfer toner, and an image forming apparatus including the recovery toner container.

2. Description of the Related Art

In an image forming apparatus, after a toner is formed on a recording material such as paper, a residual transfer toner remaining on a photosensitive body or an intermediate transfer member is conveyed and recovered into a recovery toner container by a cleaning apparatus. When a toner recovery amount in the recovery toner container reaches a predetermined amount, the recovery toner container is replaced with an empty recovery toner container.

In recent years, since effective utilization of resources has been required, reuse of even recovery toner containers, which were often discarded after replacement, has been considered. In order to reuse a recovery toner container, it is necessary to efficiently discharge toner recovered in the recovery toner container, and to clean the inside of the recovery toner container.

Japanese Patent Laid-Open No. 2009-300635 discloses a recovery toner container configuration that is intended to efficiently discharge an internal recovered toner without scattering the toner over the periphery in reuse.

In Japanese Patent Laid-Open No. 2009-300635, when the inside of a recovery toner container is cleaned, a screw member 112 is rotated to discharge a toner from a discharge portion 103. Accordingly, the toner fixed in the recovery toner container can be crushed and discharged.

However, the conventional configuration has the following problem.

In the recovery toner container disclosed in Japanese Patent Laid-Open No. 2009-300635, a spiral screw member 112 is rotated while the screw member 112 and a bearing member 107 are fitted to each other. Therefore, a toner entering a fitting portion gap between the screw member 112 and the bearing member 107 cannot be removed and cleaned off. In this case, in a toner conveyance direction downstream side, a conveyed toner may enter a fitting portion of a bearing and be pressed and adhered by a subsequent toner. Then, due to the toner adhesion, a screw rotation load may increase in reuse, thus causing trouble in functioning.

Thus, in a recovery toner container including a rotatably-supported rotating member, it is desirable to efficiently remove and clean off the recovered toner adhered to a bearing portion of the recovery toner container, while increasing the efficiency of discharging the recovered toner stored in the recovery toner container to the outside.

SUMMARY OF THE INVENTION

Accordingly, a toner container detachably attachable to an image forming apparatus body includes a recovery container body in which at least one inflow port is formed for inflow of a toner recovered after image formation, at least one rotating member which is rotatably provided to convey the recovered toner, which flows from the inflow port into the recovery container body, to a downstream side in a recovery toner conveyance direction, a discharge port which is formed at the downstream side in the recovery toner conveyance direction for discharging the recovered toner in the recovery container body, and a cover member which is arranged to be detachably attachable to the recovery container body and has a bearing portion fitted to a downstream end in the recovery toner conveyance direction of the rotating member and covers the discharge port.

Further features of the present invention will become apparent from the following description of exemplary embodiments, with reference to the attached drawings.

DESCRIPTION OF THE EMBODIMENTS

Hereafter, embodiments of the present invention will be described as examples. However, the dimensions, materials, shapes, and relative arrangement of component parts described in the following embodiments may be modified appropriately according to the configurations or various conditions of an apparatus to which the present invention is applied. Therefore, unless specifically described, the scope of the present invention is not intended to be limited thereto.

<Image Forming Apparatus 1>

Figure 1:
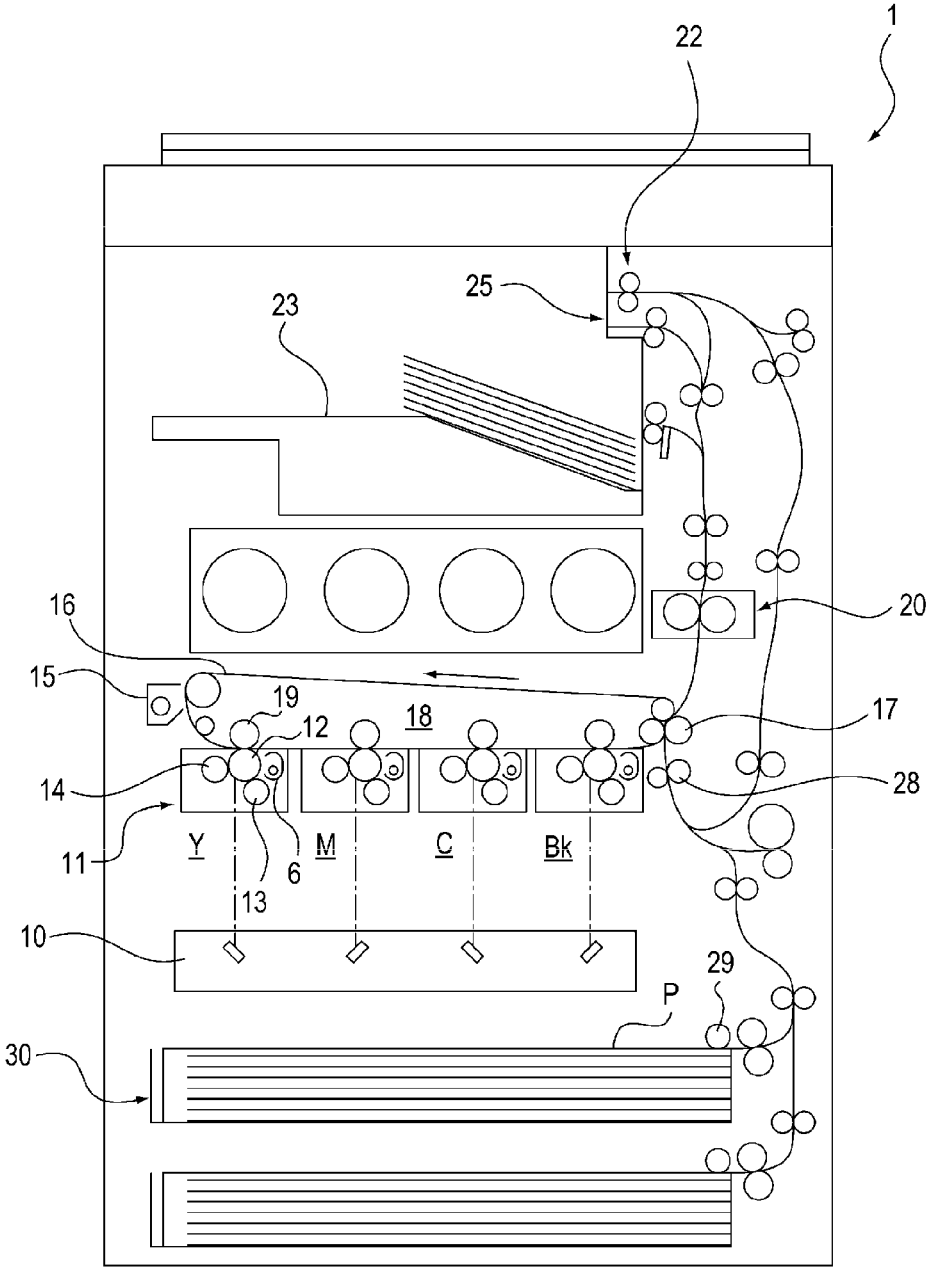
FIG. 1 is a cross-sectional view illustrating a schematic configuration of an image forming apparatus.

FIG. 1 is a cross-sectional view illustrating a schematic configuration of an image forming apparatus. In FIG. 1, a copying machine is described as an example of an image forming apparatus 1.

The image forming apparatus 1 includes a plurality of image forming portions 11 (process cartridges). The respective image forming portions 11 form, for example, toner images of respective colors of yellow (Y), magenta (M), cyan (C), and black (Bk). In FIG. 1, since the four image forming portions 11 have the same configuration, only the yellow (Y) image forming portion 11 is denoted with a reference numeral. Also, in the following description, the signs "Y, M, C, and K" representing the respective colors will be omitted, unless specifically required.

The image forming portion 11 is unitized, and is configured to be detachably attachable to a body of the image forming apparatus 1. The image forming portion 11 includes a photosensitive drum 12 (image bearing member) of an electrophotographic photosensitive body. A primary charger 13, a development device 14, and a drum cleaner 6 are arranged around the photosensitive drum 12. Also, an exposing apparatus 10 is disposed under all the photosensitive drums 12. The exposing apparatus 10 includes polygon mirrors and irradiates laser light.

Also, an intermediate transfer belt 16 (intermediate transfer member) is disposed over all the image forming portions 11, such that the intermediate transfer belt 16 abuts all the photosensitive drums 12. The intermediate transfer belt 16 extends around a plurality of rollers to constitute an intermediate transfer belt unit 18.

By the above schematic configuration, image formation is performed as follows.

A yellow image signal is transmitted from the outside to the image forming apparatus 1. Then, an electrostatic latent image corresponding to the yellow image signal is formed on the photosensitive drum 12 that is uniformly charged by the primary charger 13. The electrostatic latent image is formed by the laser light irradiated through the polygon mirrors inside the exposing apparatus 10. Thereafter, a yellow toner is supplied from the development device 14 to the electrostatic latent image. Accordingly, a yellow toner image is developed and visualized on the photosensitive drum 12 corresponding to yellow.

By the rotation of the photosensitive drum 12, the yellow toner image reaches a primary transfer region at which the photosensitive drum 12 and the intermediate transfer belt 16 abut each other. Herein, a primary transfer bias is applied to a primary transfer member 19, so that the yellow toner image on the photosensitive drum 12 is transferred to the intermediate transfer belt 16 (primary transfer).

A region of the intermediate transfer belt 16, which bears the yellow toner image, moves onto the photosensitive drum 12 of the adjacent image forming portion (magenta process cartridge in this embodiment). Then, by that time, a magenta toner image has been formed on the photosensitive drum 12 corresponding to magenta through the same process as for the development of the yellow toner image described above. Therefore, the magenta toner image is superimposed and transferred on the yellow toner image.

Likewise, by the movement of the intermediate transfer belt 16, a cyan toner image and a black toner image in the primary transfer regions of the respective image forming portions are sequentially superimposed and transferred on the above-described yellow toner image and magenta toner image.

On the other hand, a recording material P is stored in a cassette 30. The recording material P is fed one by one from the cassette 30 by a pickup roller 29. The fed recording material P is time-synchronized with image formation timing in a registration roller 28. Thereafter, the recording material P reaches a secondary transfer region that is nipped between the intermediate transfer belt 16 and a secondary transfer roller 17. Herein, by a secondary transfer bias applied to the secondary transfer roller 17 (secondary transfer portion), four-color toner images on the intermediate transfer belt 16 are transferred in a lump onto the recording material P (secondary transfer).

The recording material P, onto which the four-color toner images have been transferred, guided by a conveying guide, is conveyed to a fixing device 20 (fixing portion) disposed over the secondary transfer roller 17, and is subjected to heat and pressure in the fixing device 20. Accordingly, the respective color toners are melted and color-mixed, so that a full-color toner image is fixed onto the recording material P.

Thereafter, the recording material P, onto which the toner image has been fixed, is guided by the conveying guide, and is discharged onto a discharge tray 23 by discharge rollers 25 (discharge member) that are provided at a plurality of positions in a recording material conveying direction downstream of the fixing device 20.

In a single-side mode performing image formation on one side of the recording material P, the recording material P, on one side of which an image has been formed as described above, is discharged onto the discharge tray 23 by the discharge rollers 25.

On the other hand, in a duplex mode performing image formation on both sides of the recording material P, the recording material P, on one side of which an image has been formed as described above, is reversed through a duplex path and then conveyed to a registration roller 22. Thereafter, rear-side recording is completed through the same image forming process as for the front-side recording, and the recording material P, on the front and rear sides of which images has been formed, is discharged onto the discharge tray 23 by the discharge rollers 25.

Also, since the image forming portion 11 and the intermediate transfer belt 18 have a shorter life than that of the image forming apparatus 1, the image forming portion 11 and the intermediate transfer belt 18 need to be replaced in order to fulfill the body life. Therefore, both the image forming portion 11 and the intermediate transfer belt 18 are made detachably attachable, thereby improving maintenance thereof.

Also, residual transfer toner remaining in the photosensitive drum 12 and the intermediate transfer belt 16 is recovered by a residual transfer toner recovering mechanism that will be described below. The residual transfer toner of the photosensitive drum 12 is recovered by the drum cleaner 6, and the residual transfer toner of the intermediate transfer belt 16 is recovered by a belt cleaner 15.

<Residual Transfer Toner Recovering Mechanism 2>

Next, a configuration of a residual transfer toner recovering mechanism recovering residual transfer toner after image formation will be described in detail.

FIG. 2 is a cross-sectional view illustrating a drum cleaning mechanism and a belt cleaning mechanism. Also, in the following description, a longitudinal direction is a direction parallel to a rotational axis direction of the photosensitive drum 12. The terms "front side or front" and "inner side or rear" represent "the front side or front" and "the inner side or rear" when viewed from the front side of the image forming apparatus. Also, the terms "left side" and "right side" represent "the left side" and "the right side" when viewed from the front side of the image forming apparatus.

A blade type cleaner will be described as an example of the drum cleaner 6 and the belt cleaner 15.

Figure 2A:
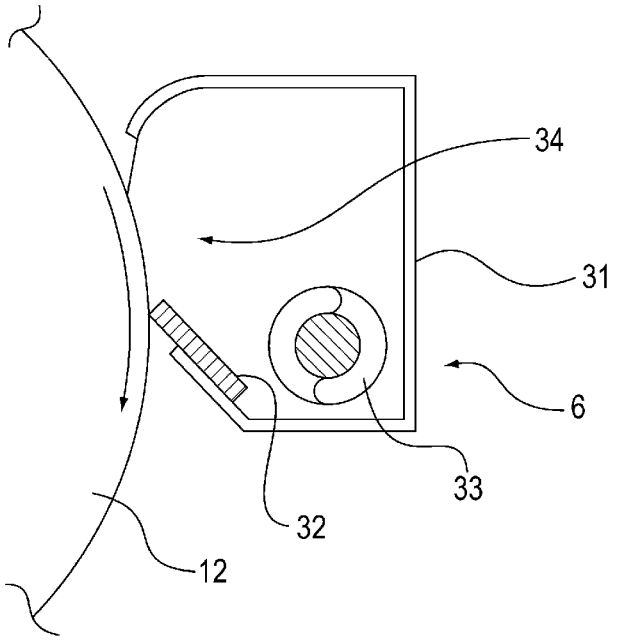
FIG. 2A is a cross-sectional view illustrating a drum cleaning mechanism and a belt cleaning mechanism.

As illustrated in FIG. 2A, the drum cleaner 6 includes a drum cleaner container 31, a cleaning blade 32, and a toner conveying screw 33.

The cleaning blade 32 is disposed at an opening 34 of the drum cleaner container 31 such that the cleaning blade 32 faces the photosensitive drum 12. The cleaning blade 32 is an elastic blade with an edge portion abutting a surface of the rotating photosensitive drum 12 in a counter direction. By this configuration, the residual transfer toner on the surface of the photosensitive drum 12 in the primary transfer is scraped off by the cleaning blade 32 and then recovered into the drum cleaner container 31.

The toner conveying screw 33 is disposed in a longitudinal direction in a bottom inside the drum cleaner container 31, and is driven to rotate by a driving portion (not illustrated). By the rotation of the toner conveying screw 33, the recovered toner is conveyed to a front side end of the drum cleaner container 31. A cylindrical toner discharge path 35 having an inside diameter substantially equal to the diameter of the toner conveying screw 33 (which will be described below) is provided at the front side end of the drum cleaner container 31.

Figure 2B:
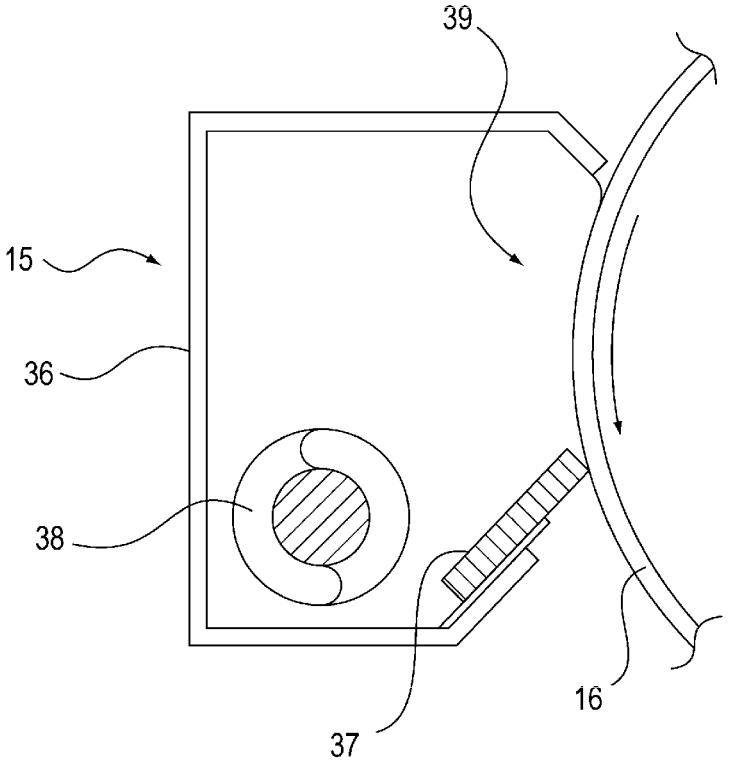
FIG. 2B is a cross-sectional view illustrating a drum cleaning mechanism and a belt cleaning mechanism.

As illustrated in FIG. 2B, the belt cleaner 15 includes a belt cleaner container 36, a cleaning blade 37, and a toner conveying screw 38.

The cleaning blade 37 is disposed at an opening 39 of the belt cleaner container 36 such that the cleaning blade 37 faces the intermediate transfer belt 16. The cleaning blade 37 is an elastic blade with an edge portion abutting a surface of the rotating intermediate transfer belt 16 in a counter direction. By this configuration, the residual transfer toner on the surface of the intermediate transfer belt 16 in the secondary transfer is scraped off by the cleaning blade 37 and then recovered into the belt cleaner container 36.

The toner conveying screw 38 is disposed in a longitudinal direction in a bottom inside the belt cleaner container 36, and is driven to rotate by a driving portion (not illustrated). By the rotation of the toner conveying screw 38, the recovered toner is conveyed to a front side end of the belt cleaner container 36. A cylindrical toner discharge path 40 having an inside diameter substantially equal to the diameter of the toner conveying screw 38 (which will be described below) is provided at the front side end of the belt cleaner container 36.

Next, a positional relation between the drum cleaner 6 and the belt cleaner 15 will be described.

Figure 3:
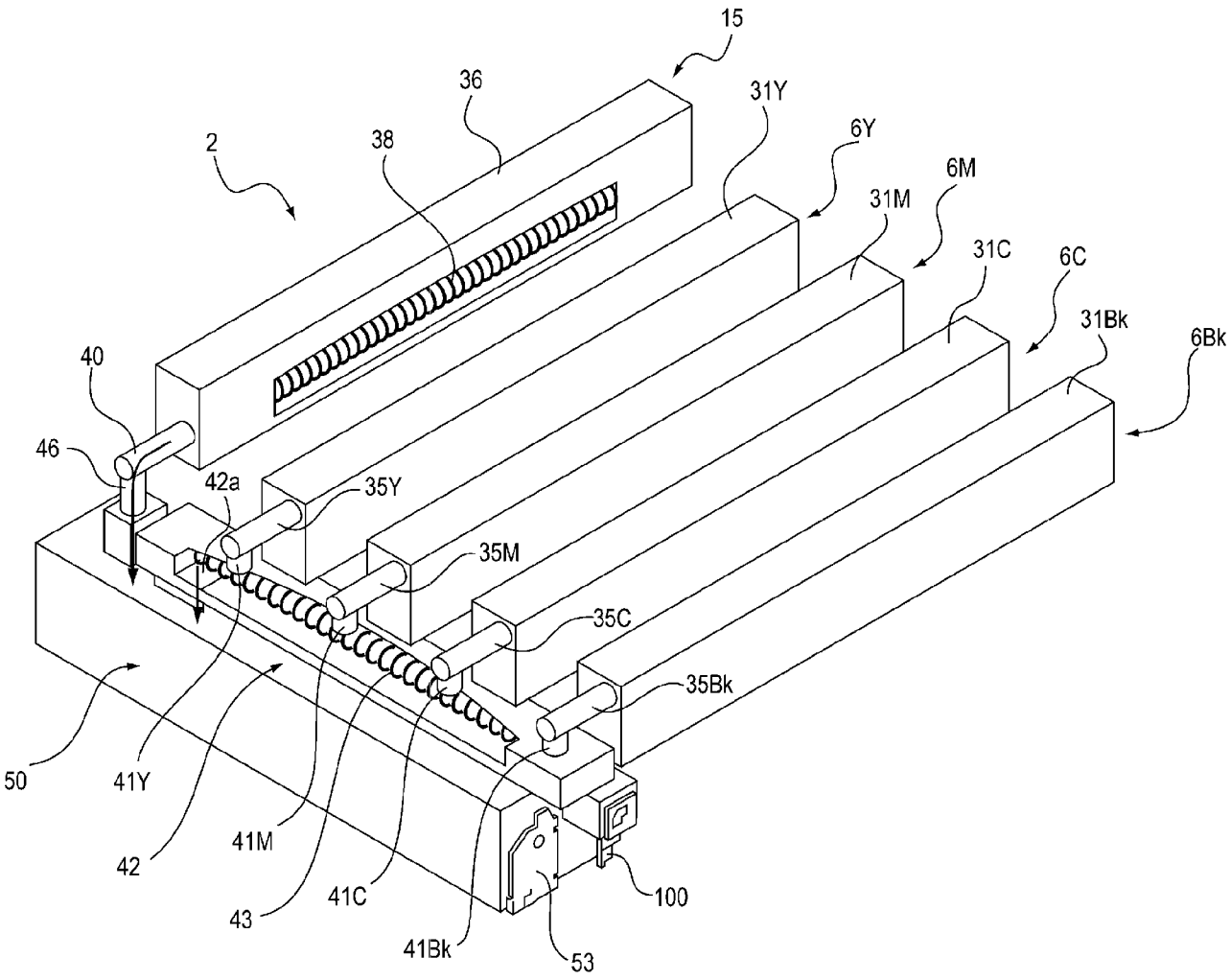
FIG. 3 is an illustration diagram of a residual transfer toner recovering mechanism.

FIG. 3 is an illustration diagram of a residual transfer toner recovering mechanism. FIG. 3 illustrates a partially cut-away state for description. Also, in FIG. 3, for description, the respective members will be denoted by the signs "Y, M, C, and K" representing the respective toner colors whenever necessary. For example, the drum cleaner 6 corresponding to yellow will be denoted by "6Y".

When a front cover of the image forming apparatus 1 is opened, the front side of the body of the image forming apparatus is opened. Then, a residual transfer toner recovering mechanism 2 is exposed as illustrated in FIG. 3. The residual transfer toner recovering mechanism 2 includes a drum cleaner 6 and a belt cleaner 15. Next, detailed configurations of respective portions of the residual transfer toner recovering mechanism 2 will be described below.

Drum cleaners 6 (6Y, 6M, 6C, and 6Bk), respectively, include toner discharge paths 35 (35Y, 35M, 35C, and 35Bk) at the front sides of drum cleaner containers 31 (31Y, 31M, 31C, and 31Bk). Connecting pipes 41 (41Y, 41M, 41C, and 41Bk) are arranged under the front sides of the respective toner discharge paths 35.

At the front sides of the four drum cleaners 6, under the toner discharge paths 35 of the drum cleaners 6, a first conveying path 42 extends in an arrangement direction of the four drum cleaners 6, that is, a horizontal direction. The respective connecting pipes 41 suspending from the respective toner discharge paths 35 are all connected to the top of the first conveying path 42.

The first conveying path 42 includes a toner conveying screw 43 for conveying the recovered toner. The toner conveying screw 43 extends in a longitudinal direction of the first conveying path 42, and conveys the recovered toner to the left side of the drawing. A first toner discharge port 42*a* is formed at the left bottom of the first conveying path 42.

By this configuration, the recovered toner recovered in the respective drum cleaners 6 is conveyed by the toner conveying screw 43 to the front side, and falls from the respective connection pipes 41 through the respective toner discharge paths 35. The fallen recovered toner enters the first conveying path 42, is conveyed to the left side of the drawing by the toner conveying screw 43, and falls from the first toner discharge port 42*a*.

On the other hand, the belt cleaner 15 is arranged such that the longitudinal direction of the belt cleaner 15 is parallel to the longitudinal direction of the four drum cleaners 6. The toner conveying screw 38 is arranged inside the belt cleaner container 36. The toner discharge path 40 protrudes at the front side of the belt cleaner container 36, and a second conveying path 46 is arranged under the front side of the toner discharge path 40 to guide the recovered toner in the vertically downward direction.

By this configuration, the recovered toner recovered into the belt cleaner container 36 is conveyed by the toner conveying screw 38 to the front side, and falls from the second conveying path 46 through the toner discharge path 40.

A recovery toner container 50 is arranged under the first conveying path 42 to which the recovered toner of the photosensitive drum 12 has been conveyed, and under the second conveying path 46 to which the recovered toner of the intermediate transfer belt 16 has been conveyed. The recovery toner container 50 includes a recovery container body 55 having a substantially rectangular shape. The recovery toner container 50 extends in a direction parallel to the longitudinal direction of the first conveying path 42, that is, a horizontal direction.

The recovery toner container 50 is arranged to be detachably attachable to the image forming apparatus body. In the image forming apparatus of this embodiment, the attachment/detachment of the recovery toner container 50 to/from the image forming apparatus body is performed by opening the front cover of the image forming apparatus.

Figure 4:
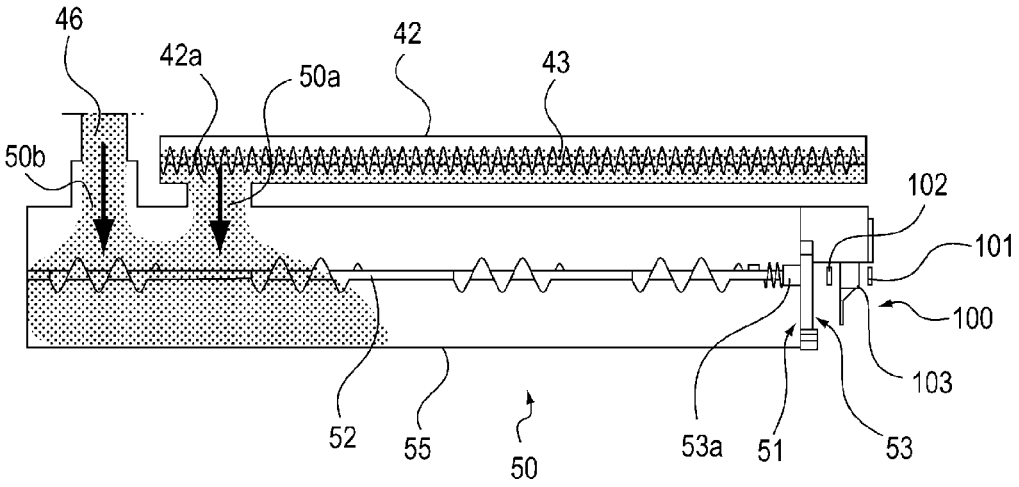
FIG. 4 is a cross-sectional view illustrating the state when a recovered toner flows into a recovery toner container.

The relation between the recovery toner container 50, the first conveying path 42, and the second conveying path 46 will be described with reference to FIG. 4. FIG. 4 is a cross-sectional view illustrating the state where the recovered toner flows into the recovery toner container.

As inflow ports of the recovered toner, a first recovering port 50*a* and a second recovering port 50*b* are formed on the recovery container body 55. The first recovering port 50*a* is arranged under the first toner discharge port 42*a* of the first conveying path 42, and the second recovering port 50*b* is arranged under the second conveying path 46. Also, an opening diameter of the first recovering port 50*a* is larger than an opening diameter of the first toner discharge port 42*a*, and an opening diameter of the second recovering port 50*b* is larger than an opening diameter of the second conveying path 46.

By this configuration, the recovered toner recovered into the drum cleaner container 31 by the drum cleaner 6 is conveyed through the first conveying path 42 to the left side of the drawing, falls from the first toner discharge port 42*a* (shown by an arrow in the drawing), and flows into the recovery toner container 50. On the other hand, the recovered toner recovered into the belt cleaner container 36 by the belt cleaner 15 falls to the second conveying path 46 located at the front side of the toner discharge path 40 (shown by an arrow in the drawing), and flows into the recovery toner container 50.

<Details of Recovery Toner Container 50>

The recovery toner container 50 according to this embodiment will be described in detail.

Figure 5:
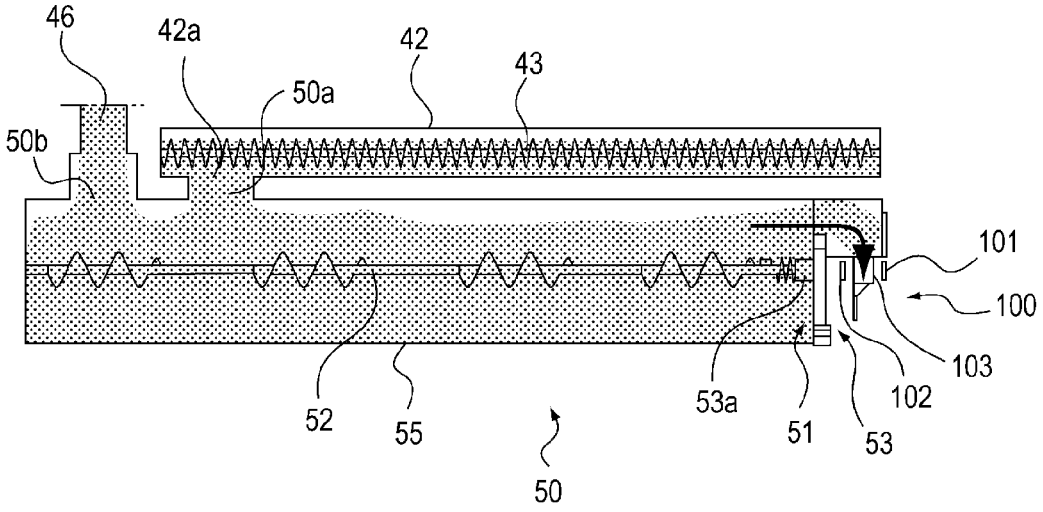
FIG. 5 is a cross-sectional view illustrating the flow of a toner from the recovery toner container into a detecting portion.

FIG. 5 is a cross-sectional view illustrating the flow of the toner from the recovery toner container into an inflow portion.

As illustrated in FIGS. 4 and 5, the recovery toner container 50 includes a rotating member 52 that is rotatably provided to convey the recovered toner and to smooth a toner surface. A rotational axis direction of the rotating member 52 is parallel to the longitudinal direction of the recovery toner container 50. A left end of the rotating member 52 is rotatably held by a gear, or the like (not illustrated), and a right end of the rotating member 52 is rotatably and axially supported by a bearing portion 53*a* that will be described below.

By this configuration, the toner, which has flowed through the first recovering port 50*a* and the second recovering port 50*b* into the vicinity of a left end portion of the recovery toner container 50, is conveyed by the rotating operation of the rotating member 52 to a right direction inside the recovery container body 55. In this process, as illustrated in FIG. 5, a top surface of the recovered toner is leveled in the recovery toner container 50.

Next, the configurations of a cover member 53 and a detecting portion 100 disposed at the right end of the recovery container body 55 will be described with reference to FIGS. 4 to 6. (FIG. 6 is an enlarged cross-sectional view of the right end of the recovery toner container.)

Figure 6:
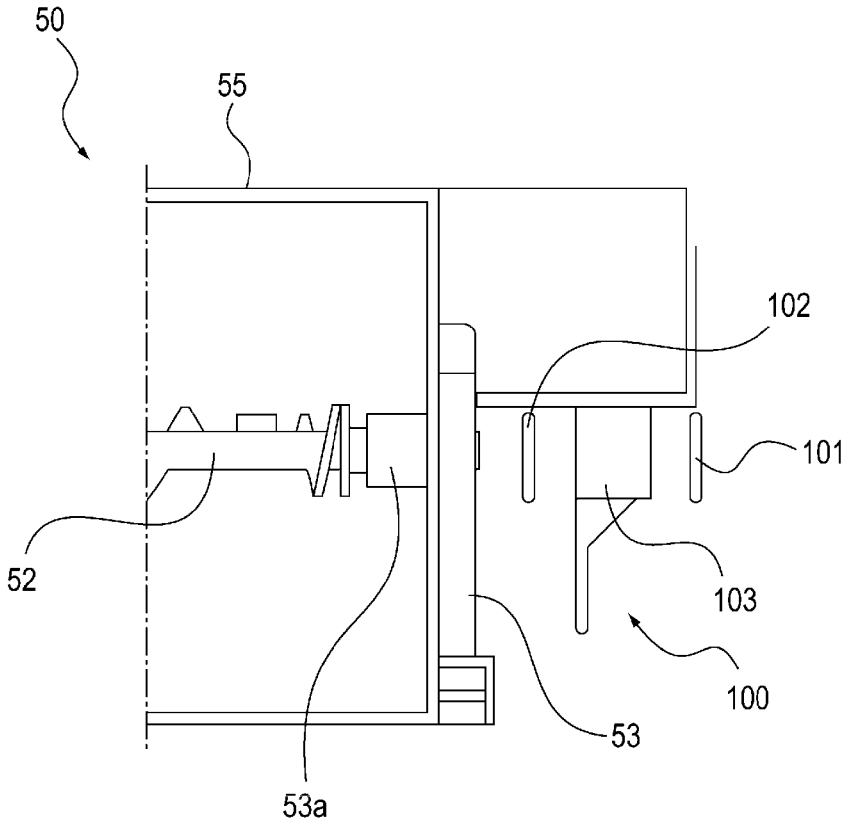
FIG. 6 is an enlarged cross-sectional view of a right end of the recovery toner container.

As illustrated in FIGS. 4 to 6, the cover member 53 is provided at the downstream side in the recovery toner conveyance direction and seals a discharge port 51 formed at the right end of the recovery toner container 50. The cover member 53 is provided with a bearing portion 53*a* that is fitted to the rotational axis of the rotating member 52 and supports the rotating member 52 rotatably and axially. The bearing portion 53*a* protrudes from the right end of the recovery toner container 50 in such a manner as to penetrate the inside of the container.

As illustrated in FIG. 6, the detecting portion 100 is provided at a right end portion of the recovery toner container 50. The detecting portion 100 includes a light emitting element 101 and a light receiving element 102 provided in the body of the image forming apparatus 1, and an inflow portion 103 that protrudes from the right end portion of the recovery toner container 50 to block an optical path of the light emitting element 101 and the light receiving element 102, and into which the recovered toner can flow.

The inflow portion 103 includes a transparent or semitransparent member that transmits light. The inflow portion 103 is suspended from the top of the right end portion of the recovery toner container 50 such that excess toner overflowed from the recovery container body 55 can enter thereinto. By this configuration, when the excess toner does not enter the inflow portion 103, the light from the light emitting element 101 penetrates the transparent inflow portion 103 and is received by the light receiving element 102. In this manner, the detecting portion 100 detects the excess toner according to whether the light receiving element 102 receives the light.

Based on this configuration, the order of detection by the detecting portion 100 will be described in detail with reference to FIGS. 4 and 5.

As illustrated in FIG. 4, when the amount of toner filled into the recovery container body 55 is small, the excess toner does not enter the inflow portion 103 disposed at the right end of the recovery container body 55. Therefore, in the detecting portion 100, the light from the light emitting element 101 penetrates the inflow portion 103 and reaches the light receiving element 102. Therefore, when the toner amount in the recovery container body 55 has not reached a predetermined value, since the light receiving element 102 receives a sufficient amount of light, the detecting portion 100 can detect that the toner amount in the recovery container body 55 has not reached a predetermined filling amount.

As illustrated in FIG. 5, when the toner amount in the recovery container body 55 has reached the predetermined filling amount, the toner is accumulated in the inflow portion 103 as represented by an arrow in the drawing. Accordingly, the quantity of light received by the light receiving element 102 varies. Then, this information is transmitted from the detecting portion 100 to a controller such as a CPU, and the controller can inform the user that it is time to replace the recovery toner container 50.

Since the recovery toner container 50 is detachably attachable to the image forming apparatus 1, the recovery toner container 50 is separated from the body of the image forming apparatus when the recovery toner container 50 reaches the replacement time. Accordingly, the toner inside the recovery container body 55 can be discharged and cleaned off.

Figure 7:
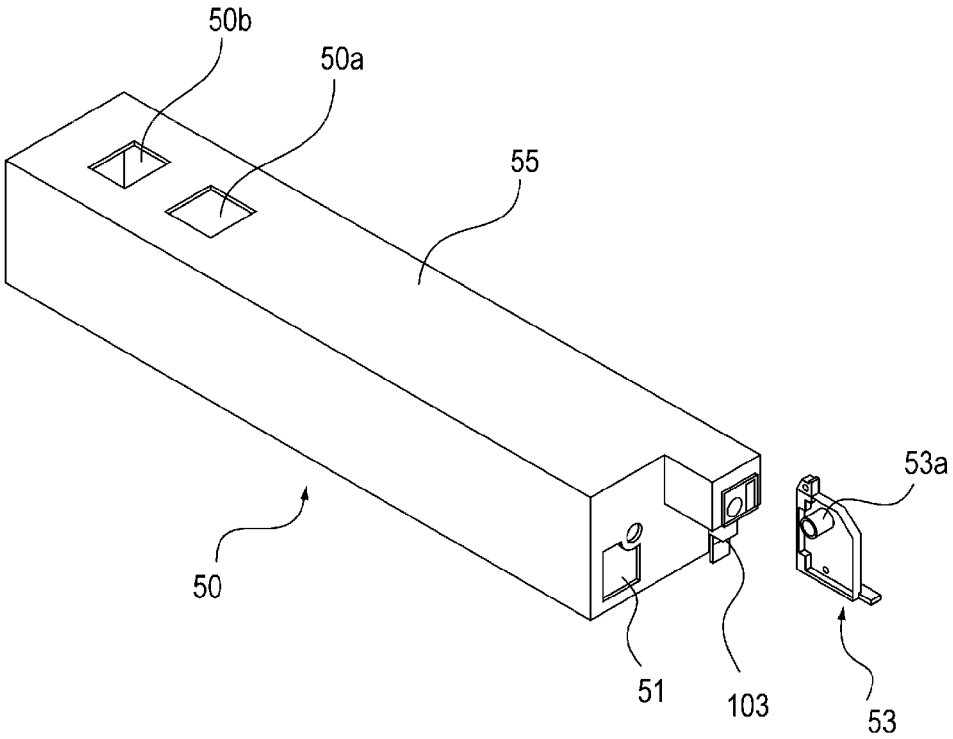
FIG. 7 is a perspective view illustrating the state when a cover member of the recovery toner container has been removed.

The time of maintenance will be described with reference to FIG. 7. FIG. 7 is a perspective view illustrating the state when the cover member of the recovery toner container has been removed.

When discharging the toner inside the recovery container body 55, if the cover member 53 is separated from the recovery toner container 50, as illustrated in FIG. 7, the recovered toner can be discharged from the discharge port 51. Herein, according to the configuration of this embodiment, the member axially supporting the downstream side end of the rotating member 52 is the bearing portion 53*a* provided at the cover member 53.

In this manner, by separating the cover member 53 in the process of discharging the recovered toner in the recovery container body, the bearing portion 53*a* fitted to the rotating member 52 is also separated from the recovery toner container 50. In this manner, by separating the recovery container body 55 and the bearing portion 53*a* from each other, the toner having entered the inside of the bearing portion 53*a* can be removed securely and easily. Then, by attaching the cover member 53 to the recovery container body 55 again, the recovered toner can be prevented from remaining in the bearing portion 53*a* when the rotating member 52 and the bearing portion 53*a* are fitted to each other.

In this manner, by preventing the recovered toner from remaining between the rotating member 52 and the bearing portion 53*a*, the rotating member 52 smoothly rotates around the bearing portion 53*a*. Then, it is possible to prevent an overload of the rotating member 52 caused by the remaining toner after the reuse of the recovery toner container 50.

In addition, according to this configuration, the discharge port 51 is provided at the right end portion of the recovery toner container 50 in the longitudinal direction. In this manner, when an opening is formed at the end portion in the longitudinal direction, since the size of an opening for discharge of the recovered toner can be relatively small, the toner contamination of the operation environment and the external appearance of the recovery toner container 50 by the scattering of the toner can be minimized.

By this embodiment, the recovered toner can be efficiently and securely discharged, and the recovery toner container can be reused. Also, since the scattering of the toner over the periphery is not generated, the operation process can be shortened, and the cost for reuse can be reduced. Also, in the case of a color image forming apparatus, since the amount of recovered toner tends to increase, as compared to the case of a single-color image forming apparatus, it can be regarded as being more effective in terms of the running cost of the image forming apparatus.

By the above configuration, when replacing and reusing the recovery toner container 50, the recovered toner therein can be efficiently and securely removed and cleaned off without scattering the toner over the periphery.

Figure 8:
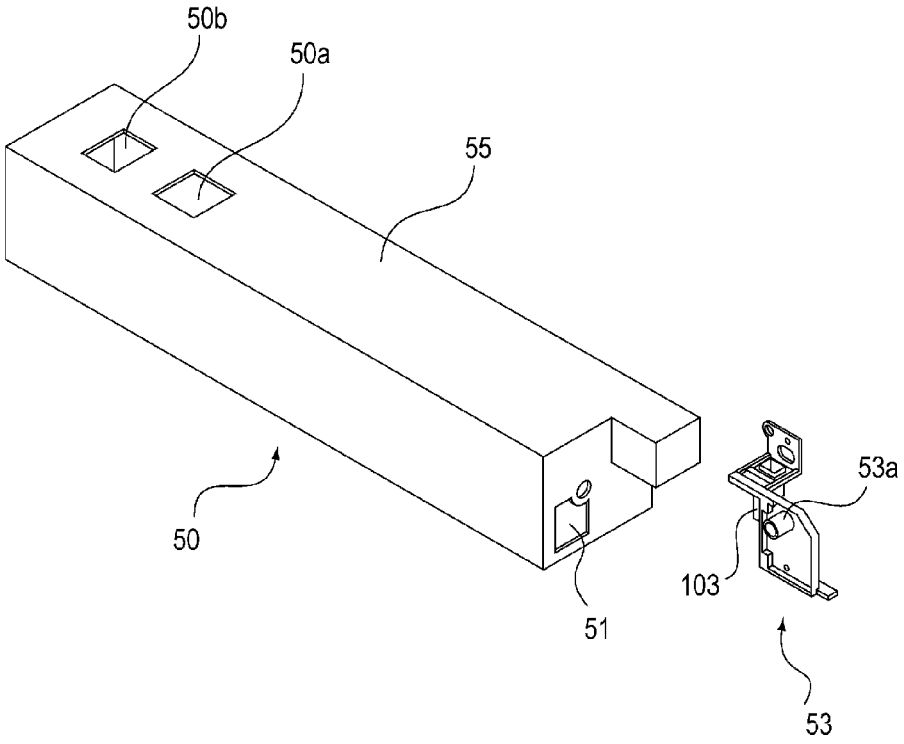
FIG. 8 is a perspective view illustrating the recovery toner container including a cover member integrated with the detecting portion.

Also, in the above-described configuration, the cover member 53 and the inflow portion 103 are separated from each other, but the present invention is not limited thereto. For example, as illustrated in FIG. 8, the cover member 53 and the inflow portion 103 may be integrated into one. FIG. 8 is a perspective view illustrating the recovery toner container including the cover member integrated with the detecting portion.

As illustrated in FIG. 8, when the cover member 53 and the inflow portion 103 are integrated into one, the inflow portion 103 can be simultaneously separated by separating the cover member 53. In this manner, when the cover member 53 and the inflow portion 103 can be simultaneously separated by integrating the cover member 53 and the inflow portion 103 into one, the inflow portion 103 can be cleaned simultaneously with the operation of discharging the toner inside the recovery toner container 50. Then, the transparency of the inflow portion 103 is restored by the cleaning, and the detection accuracy of the detecting portion 100 can be restored to the state before the reuse. Also, by the integration, the part costs can be reduced and the operation process for reuse can be shortened.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A toner container detachably attachable to an image forming apparatus body, the toner container comprising:

a recovery container body in which at least one inflow port is formed for inflow of toner recovered after image formation;

at least one rotating member which is rotatably provided to convey the recovered toner, which flows from the inflow port into the recovery container body, to a downstream side in a recovery toner conveyance direction;

a discharge port which is formed at the downstream side in the recovery toner conveyance direction for discharging the recovered toner in the recovery container body;

a cover member which is arranged to be detachably attachable to the recovery container body and has a bearing portion fitted to a downstream end in the recovery toner conveyance direction of the rotating member and covers the discharge port; and an inflow portion into which the recovered toner flows when a filling amount of the recovered toner in the recovery container body reaches a predetermined amount, wherein the cover member and the inflow portion are integrated into one.

2. An image forming apparatus comprising:

an image forming portion; and the toner container according to claim 1, which recovers toner after image formation by the image forming portion.

* * * * *